US008714855B2

(12) United States Patent
Littig et al.

(10) Patent No.: US 8,714,855 B2
(45) Date of Patent: May 6, 2014

(54) APPARATUS FOR TREATING A STAIN IN CLOTHING

(75) Inventors: Janet Sue Littig, Hamilton, OH (US); Morgan Thomas Leahy, Cincinnati, OH (US); Kuang-Kai Liu, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 3387 days.

(21) Appl. No.: 13/005,738

(22) Filed: Jan. 13, 2011

(65) Prior Publication Data

US 2011/0170938 A1 Jul. 14, 2011

(30) Foreign Application Priority Data

Jan. 14, 2010 (CA) ..... 2690279

(51) Int. Cl.
*B43K 5/14* (2006.01)

(52) U.S. Cl.
USPC ..... 401/133; 401/132; 15/104.93

(58) Field of Classification Search
USPC ..... 401/132–133; 510/439; 222/541.1, 106; 206/484.1
See application file for complete search history.

(56) References Cited

U.S. PATENT DOCUMENTS

| | | | |
|---|---|---|---|
| 3,986,640 | A | 10/1976 | Redmond |
| 4,140,409 | A | 2/1979 | DeVries |
| 4,430,013 | A | 2/1984 | Kaufman |
| 4,493,574 | A | 1/1985 | Redmond et al. |
| 4,525,411 | A | 6/1985 | Schmidt |
| 4,611,715 | A | 9/1986 | Redmond |
| 5,380,110 | A | 1/1995 | Festa |
| 5,395,031 | A | 3/1995 | Redmond |
| 5,487,932 | A | 1/1996 | Dunshee |
| 5,814,159 | A | 9/1998 | Paley et al. |
| 5,840,675 | A | 11/1998 | Yeazell |
| 5,895,504 | A | 4/1999 | Sramek et al. |
| 6,007,264 | A | 12/1999 | Koptis |
| 6,041,930 | A | 3/2000 | Cockburn et al. |

(Continued)

FOREIGN PATENT DOCUMENTS

| | | |
|---|---|---|
| DE | 298 10 632 U1 | 11/1998 |
| DE | 29810632 | 11/1998 |

(Continued)

OTHER PUBLICATIONS

International Search Report for International Application Serial No. PCT/US2011/021082, mailed May 13, 2011, 11 pages.

(Continued)

*Primary Examiner* — David Walczak
*Assistant Examiner* — Jennifer C Chiang
(74) *Attorney, Agent, or Firm* — Gary J. Foose

(57) ABSTRACT

A package for treating stained fabric. The package can have a backing layer having a second side and a pouch layer joined thereto to form a pouch. A fluid pervious contact substrate can be joined to a first side of the backing layer. The pouch can contain a stain treatment fluid. The package can have a first position in which first and second planar regions of the backing layer are substantially in plane with one another. The package can have a second position in which first planar region and second planar region are in a substantially angularly facing relationship. In the second position the pouch can be in fluid communication with the contact substrate. The stain treatment fluid can include a surfactant.

28 Claims, 11 Drawing Sheets

(56) References Cited

U.S. PATENT DOCUMENTS

| | | | | |
|---|---|---|---|---|
| 6,262,009 | B1 * | 7/2001 | Rogers et al. | 510/439 |
| 6,315,480 | B1 | 11/2001 | Martel et al. | |
| 6,475,934 | B1 | 11/2002 | Nonaka et al. | |
| 6,832,867 | B2 | 12/2004 | Sandbach et al. | |
| 6,846,332 | B2 | 1/2005 | Boissie et al. | |
| 6,866,145 | B2 | 3/2005 | Richards et al. | |
| 6,945,391 | B2 | 9/2005 | Moodie | |
| 6,987,086 | B2 * | 1/2006 | Deak et al. | 510/285 |
| 7,121,409 | B1 | 10/2006 | Hamilton et al. | |
| 7,255,506 | B2 | 8/2007 | Gruenbacher et al. | |
| 7,320,398 | B2 | 1/2008 | Bertl et al. | |
| 7,506,762 | B2 | 3/2009 | Nelson et al. | |
| 7,552,823 | B2 | 6/2009 | Schuehrer | |
| 7,604,623 | B2 | 10/2009 | Brunner et al. | |
| 8,028,837 | B2 | 10/2011 | Gerstle et al. | |
| 8,113,730 | B2 | 2/2012 | Maloney et al. | |
| 2002/0017310 | A1 | 2/2002 | Gruenbacher et al. | |
| 2004/0000563 | A1 | 1/2004 | Rendle et al. | |
| 2005/0133174 | A1 | 6/2005 | Gorley et al. | |
| 2005/0178086 | A1 | 8/2005 | Bakken | |
| 2005/0244211 | A1 | 11/2005 | Brunner et al. | |
| 2006/0245816 | A1 | 11/2006 | Sharp et al. | |
| 2006/0283727 | A1 | 12/2006 | Nelson et al. | |
| 2007/0068845 | A1 | 3/2007 | Schuehrer | |
| 2007/0138204 | A1 | 6/2007 | Chen et al. | |
| 2007/0147942 | A1 | 6/2007 | Sojka et al. | |
| 2007/0183836 | A1 | 8/2007 | Lampe et al. | |
| 2007/0189835 | A1 | 8/2007 | Klocke et al. | |
| 2008/0230298 | A1 | 9/2008 | Buch et al. | |
| 2009/0074502 | A1 | 3/2009 | Maloney et al. | |
| 2010/0059402 | A1 | 3/2010 | Burattini | |
| 2010/0065582 | A1 | 3/2010 | Nelson et al. | |
| 2010/0264044 | A1 | 10/2010 | Beihoffer et al. | |

FOREIGN PATENT DOCUMENTS

| | | |
|---|---|---|
| EP | 1227047 | 7/2002 |
| GB | 1 585 318 | 2/1981 |
| WO | WO 81/00196 | 2/1981 |
| WO | WO 0059334 | 10/2000 |

OTHER PUBLICATIONS

Shout Wipe & Go Instant Stain Remover Wipes, printed from S.C. Johnson website http://www.whatsinsidescjohnson.com/en-us/products-by-brand/shout/shout-wipe—go-instant-stain-remover-wipes.aspx, on Mar. 2, 2012, 8 pages.

Declaration Under 35 C.F.R. §1.132, signed by Kuangkai Liu on Aug. 9, 2012 for U.S. Appl. No. 13/005,713, filed Jan. 13, 2011.

Declaration Under 35 C.F.R. §1.132, signed by Alvin So on Aug. 15, 2012 for U.S. Appl. No. 13/005,713, filed Jan. 13, 2011.

U.S. Appl. No. 13/561,630, filed Jul. 30, 2012, Stephenson, Jr.

* cited by examiner

APPARATUS FOR TREATING A STAIN IN CLOTHING

FIELD OF THE INVENTION

Treating stains in clothing.

BACKGROUND OF THE INVENTION

Many consumers experience a stain on their clothing when they are away from home, such as might occur when dining out before a theater engagement. Appearing in public with a clothing stain can be embarrassing to the wearer. If such a stain were to occur at home, the wearer could choose another garment or might be able to effectively treat the stain with a stain treatment system. When away from her house, her options may be limited.

There are presently stain treatment systems, such as pens and wipes, that release a stain treatment fluid and can be used to scrub a stain. The pens tend to be shaped like ordinary drawing markers, the bulkiness of which might drive some consumers to only carry such a pen when they are carrying a purse. However, if the consumer does not often carry a purse, they are vulnerable to a stain occurring when they are without a stain treatment system.

If the consumer carries a wipe for treating stains, the consumer can grasp the wipe and scrub the stain. The wipes can contain a formulation of color safe bleaches and surfactants. Some of these formulations can have an odor that the consumer might not like. By handling the wipe, such odor may be imparted to the consumer's skin, which might conflict with a perfume the wearer has donned. Further, some consumers might not like the feeling of grasping a wet wipe that might have a soapy feel.

One approach to stain treatment is to consider the discrete characteristics of the stain and identify and effective treatment strategy for each element. For example, one approach is to remove what can be removed and bleach what cannot be removed. Removing stains, particularly greasy stains, from fabrics can be challenging. Applying a surfactant to the stain can help with treating greasy stains. A surfactant that is stored in the interstitial spaces between fibers of a fibrous web can be delivered to a fabric when the consumer applies pressure to the fibrous web while scrubbing the stain. Alternatively, a surfactant can be delivered to the fabric through a pen type arrangement in which the head of the pen is pushed into the pen to release a stain treatment fluid. To help the stain be released from the fabric, a scraper, fibrous web, or brush can be used to dislodge the stain. Developers of this approach have sought to improve efficacy by optimizing the stain treatment fluid.

With these limitations in mind, there is a continuing unaddressed need for a compact, convenient to carry, stain treatment apparatus.

Further, there is a continuing unaddressed need for a stain treatment system that allows the consumer to use the stain treatment apparatus without having the stain treatment fluid contact her hand.

Further, there is a continuing unaddressed need for a stain treatment system in which the portion of the implement that helps to deliver a stain treatment fluid to a stain can also help with moving the stain from the fabric to at least a portion of the stain treatment system.

SUMMARY OF THE INVENTION

A package for treating a stained fabric. The package can comprise a backing layer. The backing layer can have a first side opposing a second side. The backing layer can have a line of weakness. The second side can have a first planar region and a second planar region on opposing sides of the line of weakness. A pouch layer can be joined with the second side of the backing layer thereby forming a pouch. The pouch can contain a stain treatment fluid. The package can further comprise a fluid pervious contact substrate joined to the first side of the backing layer proximal the line of weakness. The package can have a first position in which the first planar region and the second planar region are substantially in plane with one another. The package can have a second position in which the first planar region and the second planar region are in a substantially angularly facing relationship. In the first position, at least a portion of the first planar region and at least a portion of the second planar region are integral with one another. In the second position, at least a portion of the backing layer is discontinuous across the line of weakness. In the second position, the pouch is in fluid communication with the contact substrate. The stain treatment fluid can comprise from 0.001% to about 99.99%, by weight of the stain treatment fluid, of a surfactant.

DETAILED DESCRIPTION OF THE INVENTION

As used herein the term "joined" refers to the condition where a first member is attached, or connected, to a second member either directly; or indirectly, where the first member is attached, or connected, to an intermediate member which in turn is attached, or connected, to the second member either directly; or indirectly.

Figure 1:
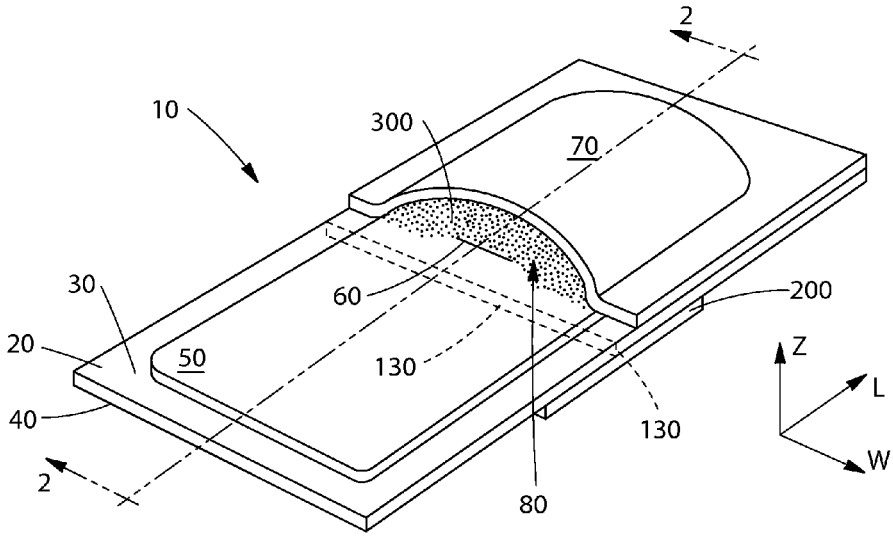
FIG. 1 is a schematic of a cut-away perspective view of a package for treating a stained fabric, the package being in the first position.

A cutaway view of a package 10 for treating a stain in a fabric is shown in FIG. 1. The package 10 may have any generally planar shape including a rectangle, a square, a circle, an oval, a triangle, a pentagon, a hexagon, a trapezoid, or any other ergonomically preferred shape. A planar shape of the package 10 can provide for a package 10 that is convenient to store and is easy to securely grip prior to and during use. The package 10 can have a length direction L and a width direction W in plane with the backing layer 20 and a Z direction orthogonal to the length direction L and width direction W. The dimensions of the package 10 can be such that in the length direction L and width direction W, the package has the planar dimensions of, or smaller than, a common wallet sized credit card or wallet sized photograph.

The package 10 can have a backing layer 20. Backing layer 20 can be made of any suitably stiff material including thin plastic materials such as polystyrene, polyethylene, polypropylene, or other polymeric material. Backing layer 20 can be sufficiently stiff to maintain package 10 in a substantially flat configuration during storage and transport. In some embodiments, the package 10 is sized and dimensioned to fit conveniently in a person's wallet, purse, diaper bag, or pocket.

The backing layer 20 has a first side 40 opposing a second side 30, the first side being towards the bottom of the package 10. The backing layer 20 can have a line of weakness 130. The first side 40 of the backing layer 20 can have a line of weakness 130. The line of weakness 130 can permit the backing layer 20 to break along the line of weakness 130 when the backing layer 20 is subjected to a sufficient bending moment. The backing layer 20 can have a first elastic limit.

The line of weakness 130 can be any number of structures that provide for a controlled break in the backing layer 20 when a sufficient bending moment is applied about the line of weakness 130. The line of weakness 130 can be selected from the group consisting of a score, a frangible portion, perforations, a slit, an aperture, and combination thereof. When the package 10 is in a pre-use condition, the structure of the backing layer 20 can have structural integrity across the line of weakness 130. A score can be a scratch, groove, compressed portion, or other structure that structurally weakens the backing layer 20. A frangible portion can be a series of scratches or compressed portions that structurally weaken the backing layer 20 to make a line of weakness 130 that is controllably rupturable when strained. The line of weakness 130 can be a perforation or series of perforations in the backing layer 20. The perforation or series of perforations can be formed by puncturing the backing layer 20 to form the perforation or series of perforations. The line of weakness 130 can be an aperture formed by selectively removing material from the backing layer 20. The line of weakness 130 can be a slit that is formed by cutting the backing layer 20. In use, as the backing layer 20 is folded upon itself about the line of weakness 130, the line of weakness 130 can rupture.

The magnitude of the bending moment needed to rupture the line of weakness can be controlled, for instance, by the depth of the score, spacing of the perforations, dimension of the aperture, dimension of the slit, whichever such structure, or other structure, is employed if such structures are employed. If a score is employed, the score can penetrate into the backing layer 20 by about 8% to about 10% of the thickness of the backing layer 20, the thickness being measured in the Z direction. A score, if employed, can penetrate into the backing layer 20 by less than about 15% of the thickness of the backing layer 20.

The line of weakness 130 can extend between the edges of the backing layer 20, as shown in FIG. 1. The line of weakness 130 can partially extend between the edges of the backing layer 20.

The backing layer 20 can be a material selected from the group consisting of rigid styrene, foil, BAREX (available from BP Chemicals Inc., Naperville, Ill., USA), polyethylene, nylon, polypropylene, and coextrudants and laminates of any of the preceding substances, and combinations thereof. The thickness of the backing layer 20 can be less than about 2 mm, can possibly be less than about 1 mm, and possibly be about 0.1 mm to about 0.5 mm. The backing layer can have a length between about 3 cm to about 10 cm and a width between about 2 cm to about 6 cm. A larger backing layer 20 might be employed for package 10 designed for use at home.

The package 10 can have a contact substrate 200 joined to the first side 40 of the backing layer 20 proximal the line of weakness 130. The contact substrate 200 can be forced into contact with the fabric to be treated during use of the package 10. The bottom of the package 10 is considered to be the side of the package 10 oriented, in use, towards the fabric to be treated.

A coating layer 50 can be joined to and facing the second side 30. The coating layer 50 can be polymer film and have a second elastic limit. The second elastic limit can be greater than the first elastic limit. In other words, the strain to break of the backing layer 20 can be less than the strain to break of the coating layer 50. The coating layer 50 can be a coextruded film, one layer being a barrier layer, such as ethanol vinyl alcohol film, oriented towards the backing layer 20 and the other layer being a linear low density polyethylene film. The coating layer 50 can be a coextruded film, one layer being a barrier layer, such as polyvinyl alcohol film (possibly EVA film which is a copolymer of ethylene and vinyl acetate), oriented towards the backing layer 20 and the other layer being a linear low density polyethylene film.

The coating layer 50 can have a transmitting portion 60. The transmitting portion 60 can be substantially aligned with the line of weakness 130 in backing layer 20. The transmitting portion 60 can be any number of structures that provide for a metering opening through the coating layer 50 when the package 20 is in use. The transmitting portion 60 can be selected from the group consisting of a score, a frangible portion, perforations, a slit, an aperture, and combination thereof. When the package 10 is in a pre-use condition, the transmitting portion 60 can be liquid impervious. A score can be a scratch, groove, or compressed portion that structurally weakens the coating layer 50. A frangible portion can be a series of scratches or compressed portions that structurally weaken the coating layer to make the transmitting portion 60 rupturable when strained. The transmitting portion 60 can be a perforation or series of perforations wherein the coating layer 50 is punctured to create the perforation or series of perforations. The transmitting portion 60 can be an aperture formed by selectively removing material from the coating layer 50. The transmitting portion 60 can be a slit that is formed by cutting or tearing the coating layer 50. The coating layer can have one or more transmitting portions 60. For instance, there can be at least one, at least two, at least three, or more, transmitting portions 60 in the coating layer 50. A plurality of transmitting portions 60 can be practical for providing wider distribution of the stain treatment fluid 300 to the contact substrate 200. A line of weakness 130 can be provided on the first side 40 of backing layer 20, second side 30 of backing layer 20, on both the first side 40 and second side 30 of backing layer 20. A line of weakness 130 can be a physical and/or chemical discontinuity internal to the structure of the backing layer 20 or on a surface of the backing layer 20.

The peripheral edges of the coating layer 50 can be joined to the backing layer 20. The coating layer 50 can be substantially continuously joined to the backing layer 20 in that more than about 75% of the surface of the portion of coating layer 50 facing the second side 30 of backing layer 20 is joined to the second side 30 of backing layer 20. The entire surface of the portion of the coating layer 50 facing the second side 30 of backing layer 20 can be joined to the second side of the backing layer 20.

The package 10 can comprise a pouch layer 70 joined with the coating layer 50 to form a pouch 80 there between, the pouch 80 being defined by the enclosed volume between the pouch layer 70 and the coating layer 50. The pouch layer 70 can be joined directly to the backing layer 20 to form a pouch there between. The pouch 80 can contain a stain treatment fluid 300. The pouch layer 70 can be heat sealed to the coating layer 50. The pouch layer 70 can be joined to the coating layer 50 using any known approach for attaching two materials including, but not limited to, adhesive, glue, ultrasonic bonding, chemical bonding, thermal bonding, and fusion bonding.

The pouch layer 70 can be a blown film or cast film. The pouch layer 70 can be liquid impervious and can be durable enough to prevent penetration or rupture of the pouch layer 70. The pouch layer 70 and coating layer 50 can also be chemically compatible with the stain treatment fluid 300 contained within the pouch 80. That is, the coating layer 50 and pouch layer 70 can be substantially inert to the stain treatment fluid 300 contained therein and the external environment for a duration sufficiently long to provide for chemical and mechanical stability from the time when the package is manufactured to the time when the package 10 is used to treat a stain. The pouch 80 can contain a volume of stain treatment fluid 300.

The pouch layer 70 can be a single layer or a laminate of multiple layers. The pouch layer 70 can comprise foil. The pouch layer 70 can be a layer of 12 μm thick sheet material, an adhesive layer, and a layer of 0.06 mm thick linear low density polyethylene. The pouch layer 70 can be white. The pouch layer 70 can be printed or otherwise labeled with a design, instruction on use, or decorative feature. The pouch layer 70 can be clear. The pouch layer 70 can be a layer of 12 μm thick metalized polyethylene terephthalate sheet material, an adhesive layer, and a layer of linear low density polyethylene. The pouch layer 70 can be a layer of 12 μm thick silver or aluminum foil, an adhesive, a 0.009 mm thick silver or aluminum foil, and a 0.05 mm linear low density polyethylene sheet material.

In one embodiment, the pouch layer 70 can be joined with the backing layer 20 to form a pouch 80 there between. The pouch layer 70 can be joined to the backing layer 20 by using any known approach for attaching two materials including, but not limited to, adhesive, glue, ultrasonic bonding, chemical bonding, thermal bonding, and fusion bonding.

Figure 2:
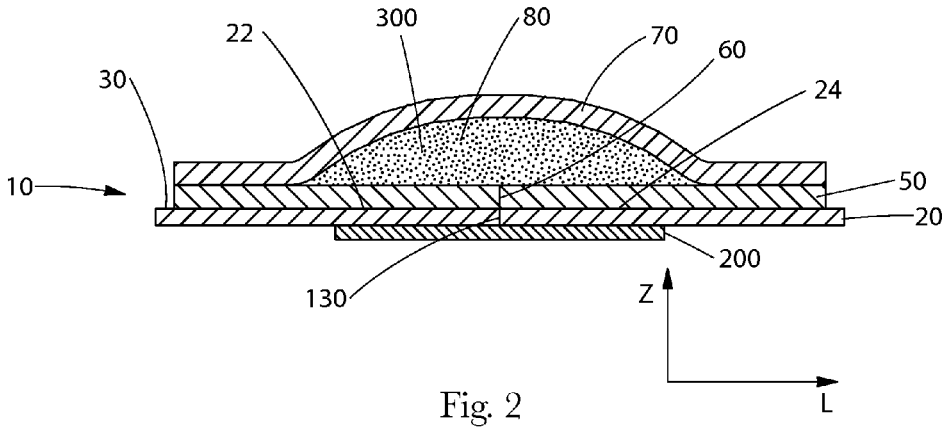
FIG. 2 is a schematic of a cross section view of the package for treating a stained fabric, as indicated in FIG. 1.

A cross section of the package 10 illustrated in FIG. 1 is shown in FIG. 2. As shown in FIG. 2, the second side 30 of backing layer 20 has a first planar region 22 and a second planar region 24 on opposing sides of the line of weakness 130. As shown in FIG. 2, the transmitting portion 60 can be substantially aligned with the line of weakness 130. When the backing layer 20 is broken, pouch 80 is in fluid communication with the contact substrate 200, the stain treatment fluid 300 flowing through the transmitting portion 60 and break in the backing layer 20 proximal the line of weakness 130 into the contact substrate 200. The coating layer 50 can be coextensive with the backing layer 20 or within the periphery of the backing layer 20. The coating layer 50 can be at least coextensive with the periphery of the backing layer 20.

Figure 3:
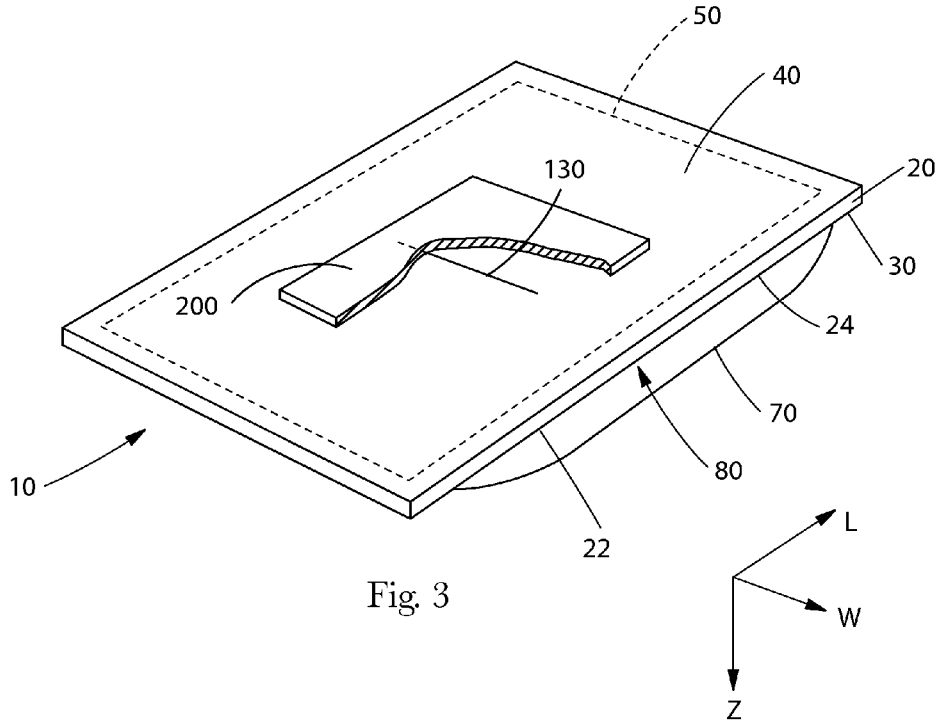
FIG. 3 is a schematic of a bottom perspective view of the package for treating a stained fabric illustrated in FIG. 1, first side 40 being presented to the viewer.

A bottom view of a package 10 is illustrated in FIG. 3. As shown in FIG. 3, the line of weakness 130 can be at least partially spatially aligned with the contact substrate 200 so that when the backing layer 20 is broken, stain treatment fluid 300 from within the pouch 80 can be transported through the break in the backing layer 20 into the contact substrate 200. As shown in FIG. 3, the line of weakness can partially extend between edges of the backing layer 20.

Figure 4:
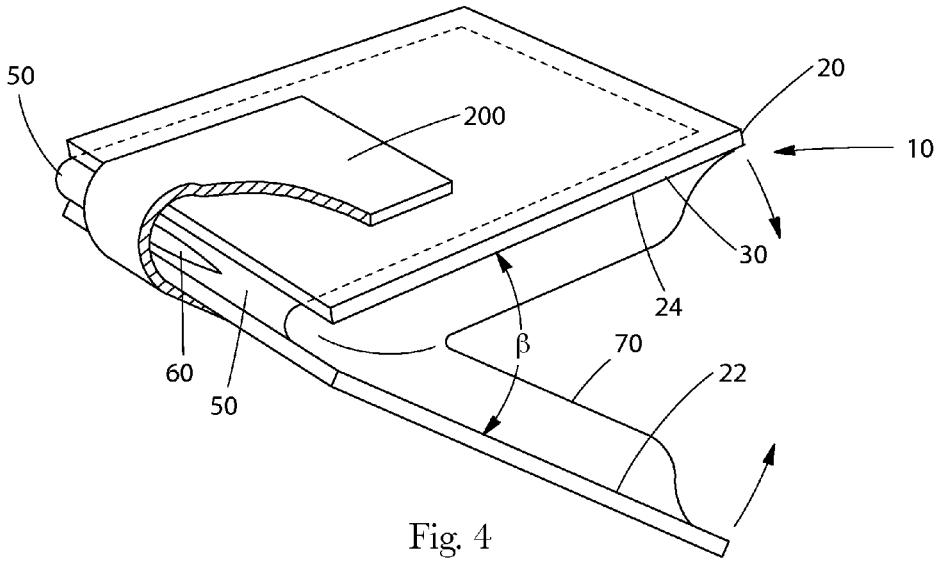
FIG. 4 is a schematic of a package for treating a stained fabric, the package being in the second position.

The package 10 can have a first position in which the first planar region 22 and second planar region 24 of the backing layer 20 are substantially in plane with one another. As shown in FIG. 4, the package 10 can be transitioned into a second position in which the first planar region 22 and second planar region 24 are in a substantially angularly facing relationship. By substantially angularly facing relationship it is meant that the first planar region 22 and the second planar region 24 are disposed with respect to one another at an interior angle β of less than about 90 degrees, the interior angle β being measured between the first planar region 22 and the second planar region 24 on the second side 30 of the backing layer 20.

In the first position, at least a portion of the first planar region 22 and the second planar region 24 can be integral with one another. The backing layer 20 can be at least partially intact across the line of weakness 130. In the second position at least a portion of the backing layer 20 can be discontinuous across the line of weakness 130. In the second position, the backing layer 20 can be broken at, proximal to, or along the line of weakness 130 so that the pouch 80 is in fluid communication with the contact substrate 200.

When the package 10 is in the first position, the package 10 can conveniently be carried in a pocket, a pocket of a wallet, pocket of a purse, or an auto glove compartment. The generally flat nature of the package 10 provides for a profile that is not bulky and can be stored conveniently.

As shown in FIG. 4, in the second position, the transmitting portion 60 can be fluid pervious. The transmitting portion 60 can be fluid pervious, for instance, as a result of a slit in the coating layer 50. As shown in FIG. 4, the transmitting portion 60 can be a slit that can be slightly stretched open. In the second position, the first planar region 22 and the second planar region 24 can be disposed at an interior angle β of less than about 45 degrees, measured between the first planer region 22 and the second planar region 24. The transmitting portion 60 can have a variety of embodiments that provide for fluid communication through the coating layer 50. In the second position, the first planar region 22 and the second planar region 24 can be disposed at an interior angle β of less than about 10 degrees, alternatively at an interior angle β of less than about 5 degrees, alternatively at an interior angle β of less than about 1 degree. In the second position, the first planar region 22 and the second planar region 24 can be disposed at an interior angle β between about zero degrees and about 5 degrees.

In the second position, the pouch 80 can be folded upon itself and pressure applied through the first planar region 22 and the second planar region 24 can extrude out the stain treatment fluid 300 contained within the pouch 80. As the first planar region 22 and second planar region 24 are brought in closer angular facing relationship, more of the stain treatment fluid 300 contained within the pouch 80 can be expressed or extruded. Once a significant squeezing force is applied by the user, the first planar region 22 and second planar region 24 can be pressed towards one another driving out stain treatment fluid 300 from the pouch 80, through the transmitting portion 60 and into the contact substrate 200. The backing layer 20 folded upon itself can provide for a convenient gripping structure for the user of the package 10 to grasp as she rubs the contact substrate 200, if present, back and forth across the stain on the fabric being treated.

In the second position, the gripping structure provided by the backing layer 20 folded upon itself can allow the consumer to effectively use the package 10 to treat a stain, without having her hand contact the stain treatment fluid 300 or contact substrate 200. Further, such gripping structure can provide for a sturdy structure that the consumer can rub back and forth vigorously, thereby rubbing the contact substrate 200 or edges of the broken backing layer 20, if a contact substrate is not present, against the stain.

The second elastic limit of the coating layer 50 can be greater than the first elastic limit of the backing layer 20. Such a design can provide for a mechanical arrangement in which when the coating layer 50 and backing layer 20 joined together are strained, the backing layer 20 can break before the coating layer 50. Such an arrangement can be desirable because once the backing layer 20 breaks, the coating layer 50 can provide for maintaining the structural integrity of the package 10 and the transmitting portion 60 of the coating layer 50 can be remain bounded by coating layer 50 such that stain treatment fluid 300 can be metered through the transmitting portion 60. The transmitting portion 60 can have a shape that provides for controlled fluid flow there through.

Figure 5:
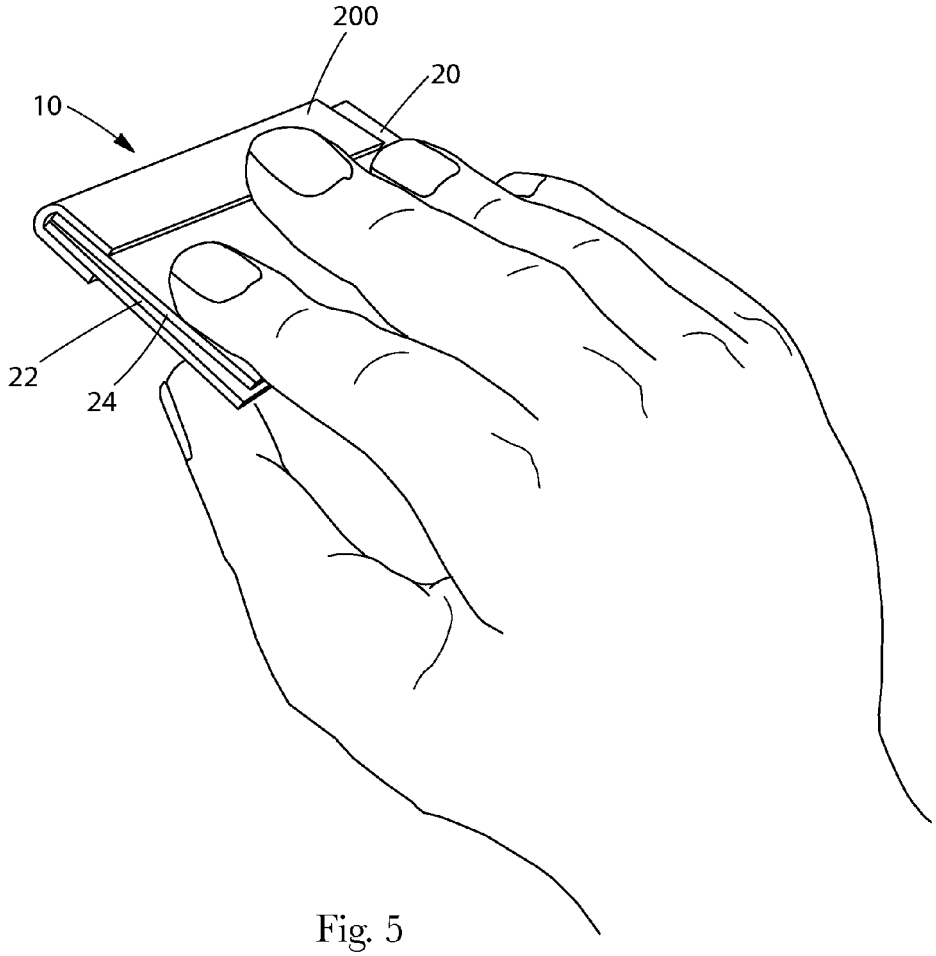
FIG. 5 is a schematic of a package for treating a stained fabric, the package being in the second position.

A stained fabric employing the package 10 can be treated by bending the backing layer 20 about the line of weakness 130 to move the first planar region 22 and the second planar region 24 into a substantially facing relationship, thereby making a portion of the backing layer to be discontinuous across the line of weakness 130. As the first planar region 22 and the second planar region 24 are pressed towards one another by the user, the stain treatment fluid 300 is dispensed to the contact substrate 200 through the portion of the backing layer 20 that is discontinuous across the line of weakness 130. The backing layer 20 is gripped, for instance in a manner similar to that shown in FIG. 5, and the user rubs the stained fabric with the contact substrate 200.

Figure 6:
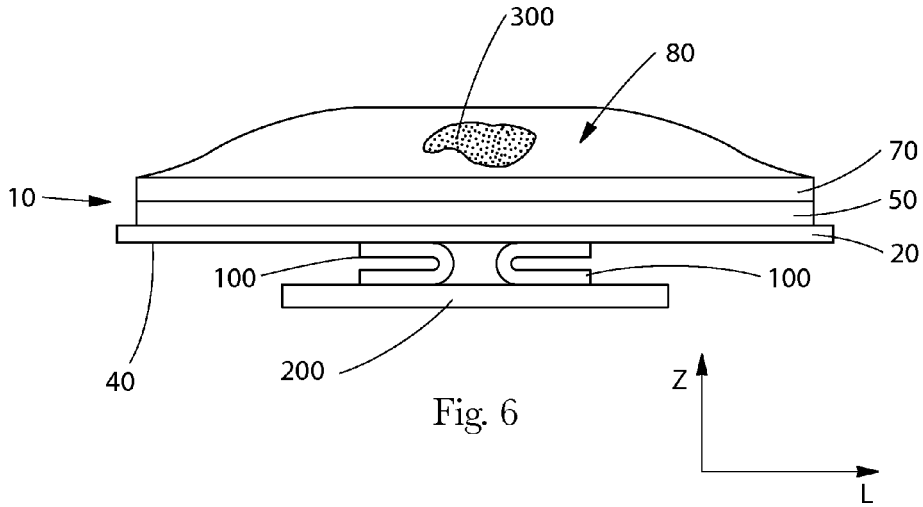
FIG. 6 is a schematic of a side view of a package for treating a stained fabric.

To allow more of the contact substrate 200 to contact the stained fabric, the contact substrate 200 can be joined to the backing layer 20 by one or more hinges 100, as shown in FIG. 6. By employing a hinged arrangement, the contact substrate can remain relatively flat even as the backing layer 20 is bent or folded about the line of weakness 130. Each hinge 100 can be formed from a flexible material that allows a variable distance to be defined between the backing layer 20 and the contact substrate 200. Each hinge 100 can be joined in part to the first side 40 and joined in part to the contact substrate 200. When the backing layer 20 is in a planar condition prior to being used to treat a stain, each hinge 100 can be closed, for example by a single bend or multiple folds in the relevant hinge 100. When each hinge 100 is closed, the contact substrate 200 can be in facing relationship with the backing layer 20, which can provide for a compact package 10. Each hinge 100 can be constructed from a piece of flexible material that is folded upon itself to have a nearly planar shape before the package is transitioned from the first position to the second position.

Figure 7:
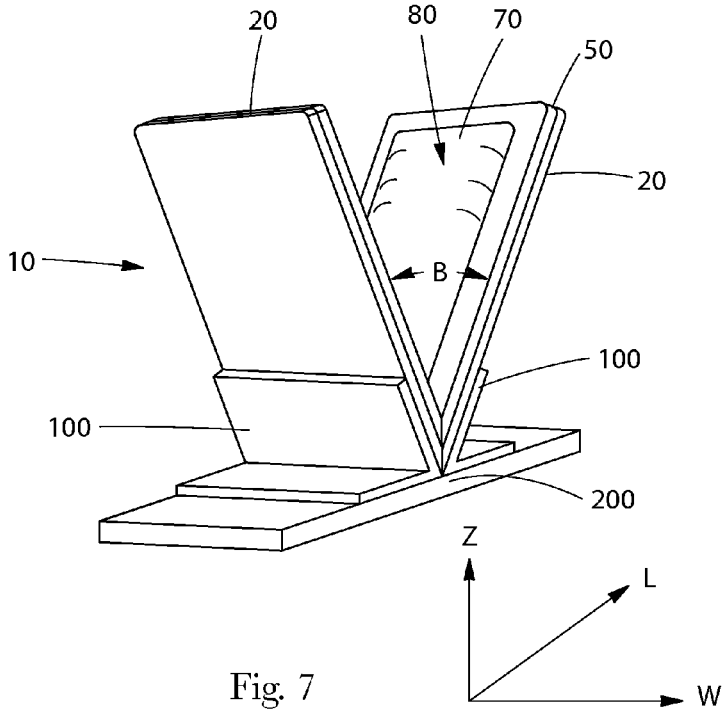
FIG. 7 is a package for treating a stained fabric, the package being illustrated in a second position.

When the backing layer 20 is broken and package 10 is transitioned from the first position to the second position by bringing the first planar region 22 and the second planar region 24 into a substantially angularly facing relationship, each hinge 100 can open to provide for a portion the contact substrate 200 to be spaced apart from the backing layer, as shown in FIG. 7. When the package is in the second position, each hinge 100 can have a generally "U" or "V" shape in cross-section, as shown in FIG. 7. Such an arrangement can provide for a conduit to direct stain treatment fluid 300 from the pouch 80 to the contact substrate 200 with limited accumulation of the stain treatment fluid 300 in other components of the package 10. Each hinge 100 can be considered to have two legs, one of which is joined to the backing layer 20 and one of which is joined to the contact substrate 200. The legs of each hinge 100 joined to the contact substrate 200 can be substantially coextensive with contact substrate 200 in that more than about 90% of the side of the contact substrate 200 facing the backing layer is joined to a hinge 100. A leg of each hinge 100 can be joined to the contact substrate 200 or the backing layer 20 using any known approach for attaching two materials including, but not limited to, adhesive, glue, ultrasonic bonding, thermal bonding, and fusion bonding. To provide for a more durable package 10, the approach for joining each hinge 100 can be chemically compatible with the stain treatment fluid 300. Each hinge 100 can be a polypropylene based tape such as 3M 3560, available from 3M.

Figure 8:
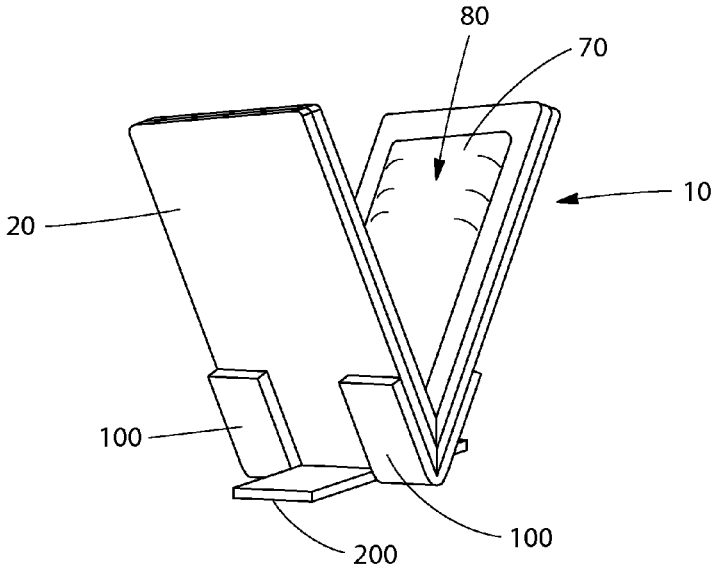
FIG. 8 is a package for treating a stained fabric, the package being illustrated in a second position.

Each hinge 100 can be an integral extension of the contact substrate 200 and comprise the same constitutive material as the contact substrate 200, as illustrated in FIG. 8. Such arrangement might provide for ease of manufacture by reducing the number parts that must be assembled to form the package 10.

Figure 9:
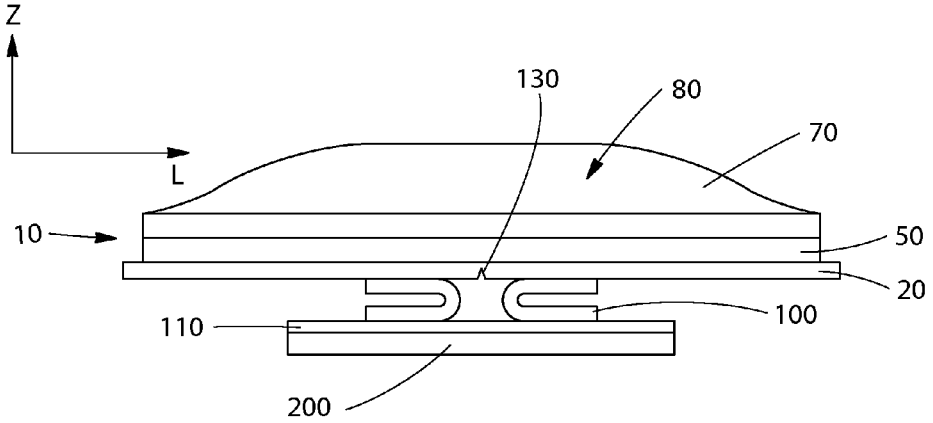
FIG. 9 is a schematic of a side view of a package for treating a stained fabric.

A foundation layer 110 can be joined to the contact substrate 200 and the backing layer 20, as shown in FIG. 9, such that the foundation layer 110 is between the contact substrate 200 and the backing layer 20 and the hinges 100, if present, are joined to the foundation layer 110. The foundation layer 110 can provide for enhanced structural stability of the package 10 when the contact substrate 200 is vigorously rubbed against a stained fabric. The foundation layer 110 can be, for example, a web of fluid permeable material, or material rendered to be selectively fluid permeable proximal the line of weakness 130, that is about coextensive with or laterally within the contact substrate 200 in the length direction L and width direction W. The foundation layer 110 can be a web of fluid permeable material that is coextensive with the contact substrate 200 in the length direction L and width direction W.

The foundation layer 110 can be joined to the backing layer 20 through each hinge 100 using any known approaches for joining two materials, including, but not limited to, adhesive, glue, ultrasonic bonding, thermal bonding, chemical bonding, and fusion bonding. Similarly, the foundation layer 110 can be directly joined to the contact substrate 200 using any known approaches for joining two materials, including, but not limited to, adhesive, glue, ultrasonic bonding, thermal bonding, chemical bonding, and fusion bonding. The foundation layer 110 can be joined to the contact substrate 200 through one or more intermediate layers. The foundation layer 110 can be a web of material selected from the group consisting of a porous film, a slit film, an apertured film, a nonwoven, a woven, and combinations thereof. The foundation layer 110 can be a polyethylene based material such as DELNET AC 530-NAT-E, high density polyethylene based substrate, having a basis weight of 18 g/m$^2$, and 0.12 mm thick, available from DelStar Technologies, Inc.

Figure 10:
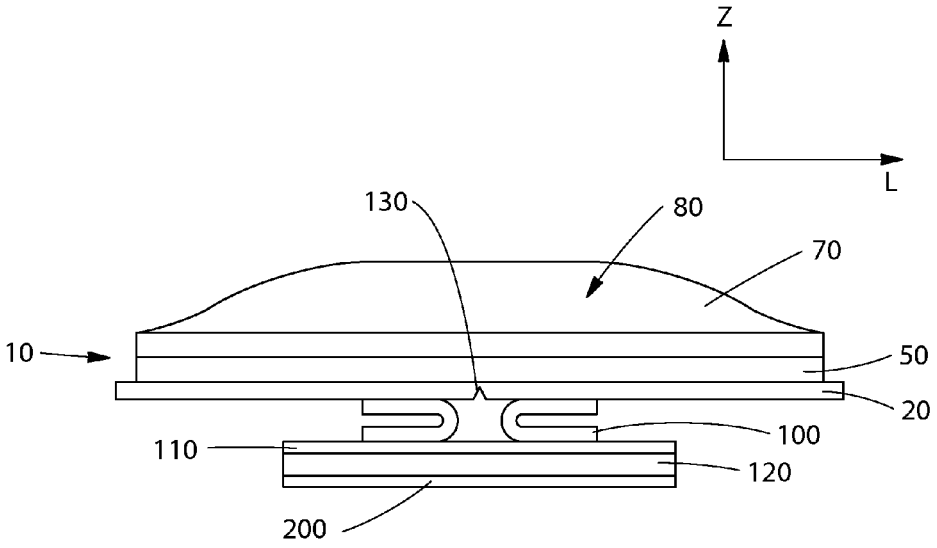
FIG. 10 is a schematic of a side view of a package for treating a stained fabric.

In some embodiments, a distribution layer 120 can be disposed in facing relationship with the contact substrate 200 and between the backing layer 20 and the contact substrate 200, for example, as shown in FIG. 10. The distribution layer 120 can provide for extensive distribution in the length direction L and width direction W of the stain treatment fluid 300 into and/or through the contact substrate 200. To promote delivery of the stain treatment fluid 300 to the fabric being treated, the distribution layer 120 can have a free absorbent capacity that is less than the volume of stain treatment fluid 300 contained in the pouch 80. The distribution layer 120 can comprise a hydrocarbon based fibrous material. The distribution layer 120 can comprise a fibrous material selected from the group consisting of polyethylene, polypropylene, nylon, polyethylene terephthalate, rayon, and combinations thereof. The distribution layer 120 can be joined to the contact substrate 200, for instance by any known approaches for attaching two materials, including, but not limited to, adhesive, glue, ultrasonic bonding, thermal bonding, chemical bonding, and fusion bonding. The distribution layer 120 can be a needle punched fibrous material. The distribution layer 120 can be a polypropylene needle punched nonwoven having a basis weight of 150 g/m$^2$. The basis weight can be determined following EDANA Standard Test: WSP 130.1 (05), Standard Test Method for Mass per Unit Area, on a 1 cm×1 cm sample and using a balance accurate to 0.0001 g. The basis weight is determined based upon 5 samples combined and calculating an average from the combined weight/area. The distribution layer 120 and foundation layer 110 can be a composite material. STRATEX 5.0NP5-E, a composite substrate made by DelStar Technologies, Inc., can provide for a single product that includes both the distribution layer 120 and foundation layer 110. This distribution layer 120 can be 1.5 mm thick. The thickness of the distribution layer can be determined following EDANA Recommended Test Method: Nonwovens Thickness (30.5-99).

The free absorbent capacity of the distribution layer 120 is measured as follows. The apparatus required includes a stainless steel test sieve of 2 mm nominal mesh size according to ISO 565, that is about 120 mm×120 mm and a dish for containing the wire gauze with the test sample. The dish must be of sufficient volume to allow a test liquid depth of 20 mm. The test liquid is 10% Sodium Dodecyl Sulfate solution in distilled water. A suitable weighing glass and cover are used. A balance having an accuracy of plus or minus 0.01 g and a stop watch are also needed.

The test is conducted in a laboratory with an ambient temperature of 25.0±0.2° C. and relative humidity 50±5%. All apparatus and samples are equilibrated in the testing environment for two hours. The test dish is covered to prevent excessive evaporation. A representative rectilinear sample of the distribution layer 120 with a weight of 1.00±0.05 grams is cut from the distribution layer material taking care not to compress or otherwise perturb the structure. The length divided by the width of the sample must be less than 2, with the length being the longer side of the sample. If an individual distribution layer 120 is not of sufficient dimensions to prepare such test pieces, more than one distribution layer 120 from more than one package 10 can be combined to provide a stack of rectilinear test pieces with the required weight and aspect ratio. Each test piece, or stack of pieces, is weighed on a balance having an accuracy of 0.01 g. A test piece (or stack) is placed on the wire gauze and is fastened thereto by a suitable clip along the width edge (i.e. within 1 mm of the edge of the material along the shorter dimension in the plane of the material). The wire mesh and attached sample are introduced to the test liquid at an oblique angle with the sample facing upwards. Once submerged, the gauze is placed horizontally 20 mm below the surface of the test liquid. This is conveniently achieved if the dish has a flat bottom and the test fluid is 20 mm deep. After sixty seconds, plus or minus one second, the gauze and test piece (or stack) are removed from the test liquid and hung freely to drain for one hundred and twenty seconds, plus or minus three seconds. The sample is oriented so that the clip is at the top horizontal edge of the sample during the draining step. After draining, the test piece (or stack) is separated from the gauze without squeezing fluid from the test piece or stack. The mass of test piece (or stack) is then determined to within ±0.1 gram. The difference between the mass of the test piece or stack prior to wetting, and the mass of the test piece or stack after wetting is the free absorbent capacity of the material in grams of fluid absorbed per gram of material. This is converted to volume of fluid absorbed per gram of material by using 1 g/cm$^3$ as the test liquid density. The free absorbent capacity is taken to be the mean of five measurements made following this procedure. Freshly conditioned test liquid is used for each set of five measurements.

Figure 11:
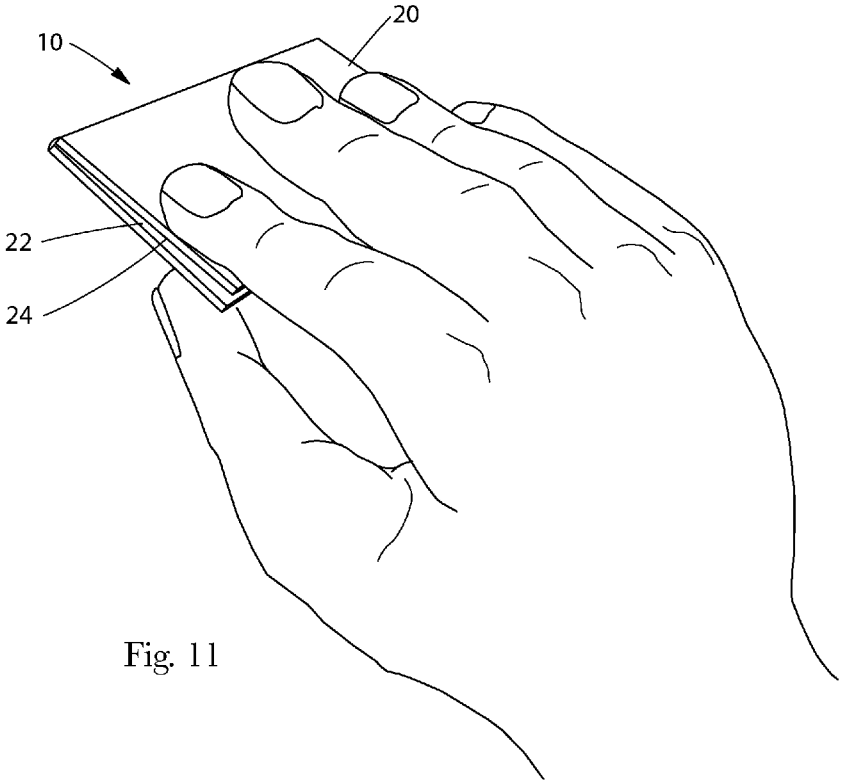
FIG. 11 is an embodiment of the package in which the package is devoid of a contact substrate.

Embodiments of the package 10 in which the package 10 is devoid of a contact substrate 200, as shown in FIG. 11, are also contemplated. When the package 10 is positioned in the second position by breaking the backing layer 20 along the line of weakness 130, stain treatment fluid 300 can flow through the discontinuity created in the backing layer 20. In other words, in the second position, the pouch 80 can be in fluid communication with the first side 40 of the backing layer. In the second position, the stain treatment fluid 300 can be expelled through the portion of the backing layer 20 that is discontinuous across the line of weakness 130. In such an embodiment, the stain treatment fluid 300 could be a gel to provide for improved control of application of the stain treatment fluid 300. As or after the fluid is applied to the fabric being treated, the broken edge of the backing layer 20 can be scraped back and forth against the fabric being treated, thereby applying and distributing the stain treatment fluid 300 to the stain and potentially dislodging agglomerations/globules of the stain, bleaching the stain, and/or brightening the fabric.

A stained fabric can be treated by employing the package 10 illustrated in FIG. 11 by bending the backing layer 20 about the line of weakness 130 to move the first planar region 22 and the second planar region 24 into a substantially facing relationship, thereby making a portion of the backing layer to be discontinuous across the line of weakness 130. As the first planar region 22 and the second planar region 24 are pressed towards one another by the user, the stain treatment fluid 300 is dispensed to the first side 40 of the backing layer 20 through the portion of the backing layer 20 that is discontinuous across the line of weakness 130. The backing layer 20 is gripped, for instance in a manner similar to that shown in FIG. 5, and the user rubs the stained fabric with the portion of the backing layer 20 that is discontinuous across the line of weakness 130.

Figure 12:
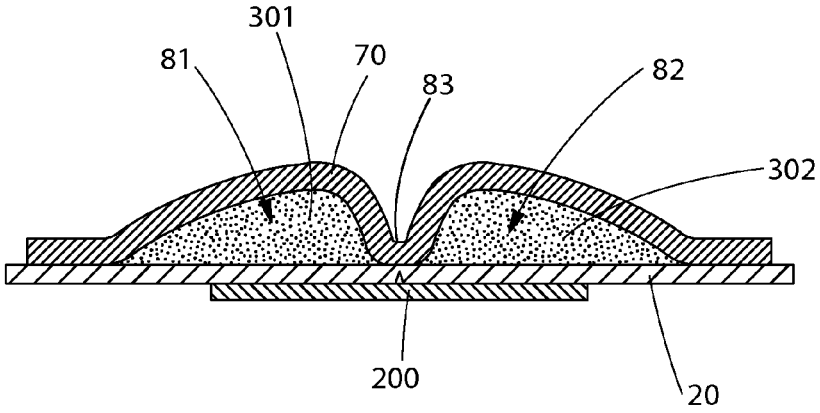
FIG. 12 is a cutaway perspective of an alternate embodiment of the package that provides for a package that can dispense a first stain treatment fluid and a second stain treatment fluid.

FIG. 12 is a cutaway perspective of an alternate embodiment of the package 10 that provides for a package that can dispense a first stain treatment fluid 301 and a second stain treatment fluid 302. This arrangement might be practical in that two materials that interact favorably or provide for treatment efficacy for different types of stains can be dispensed. For instance, the first stain treatment fluid 301 might provide for effective treatment of hydrophobic grease stains and the second stain treatment fluid 302 might provide for effective treatment of hydrophilic wine stains, for instance by bleaching. The first stain treatment fluid 301 might be a detergent and the second stain treatment fluid 302 might be a bleach compound. Such an arrangement might be beneficial for stain treatment fluid components are not stable or lose efficacy when stored together for prolong periods of time. Such an arrangement might be beneficial for stain treatment fluid components that have optimum efficacy under different local conditions (e.g. pH). The pouch layer 70 can be joined with the backing layer 20, or to the coating layer 50 if present, thereby forming a first pouch 81 and a second pouch 82. The first pouch 81 and the second pouch 82 can be separated by a separating portion 83. The separating portion 83 can be generally aligned parallel with the line of weakness 130, generally orthogonal to the line of weakness 130, or otherwise generally aligned with the line of weakness 130. The first pouch 81 can contain the first stain treatment fluid 301 and the second pouch 82 can contain the second stain treatment composition 302. A portion of the separating portion 83 can intersect a portion of the line of weakness 130.

Figure 13:
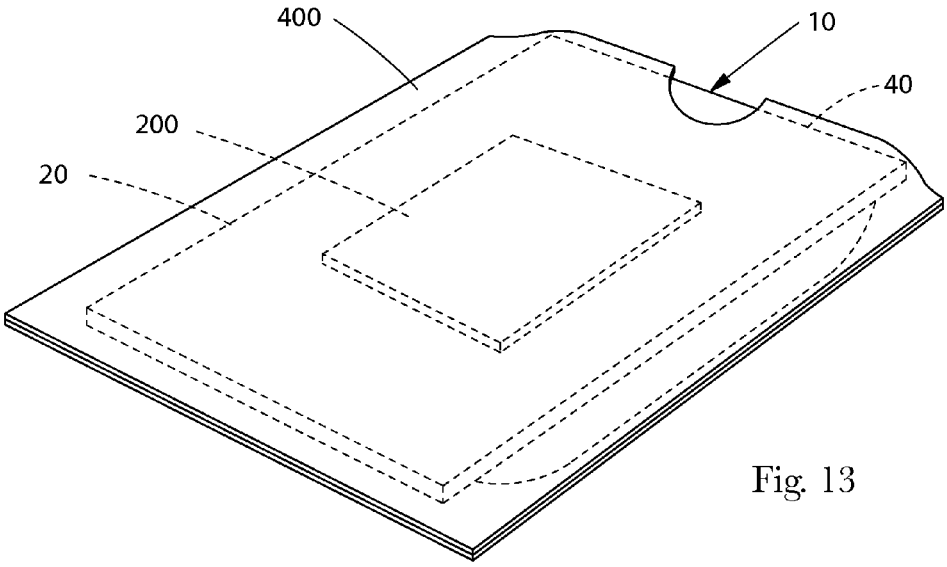
FIG. 13 is a schematic of a package covered by a removable protectant.
Figure 14:
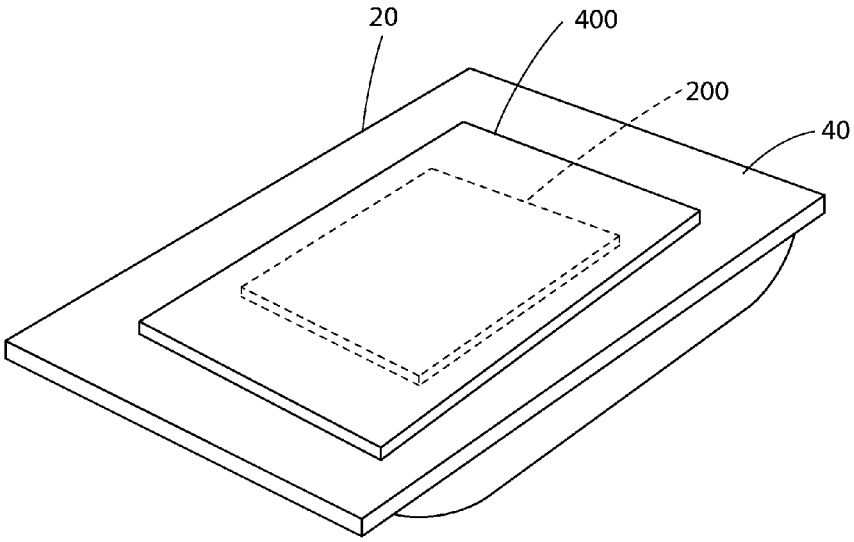
FIG. 14 is a schematic of another embodiment of a package covered by a removable protectant.

The package 10 can be covered by a removable protectant 400, for instance as shown in FIGS. 13 and 14. The first side 40 of backing layer 20 can be at least partially covered by a removable protectant 400. The removable protectant 400 can be selected from the group consisting of a wrap wrapped around the backing layer 20 and substantially covering the contact substrate 200, a slip liner at least partially enclosing the package 10, an envelope enclosing the package 10, a sealed packet enclosing the package 10, and a release strip releasably joined to the backing layer 20. The contact substrate 200 is considered to be substantially covered when more than about 75% of the surface of the contact substrate 200 oriented away from the first side 40 of the backing layer 20 is covered. The protectant 400 can be comprised of, for example, film, paper, fibrous nonwoven, foil, or any other suitably durable material that can withstand the wear and tear that might occur to such protectant 400 containing the package 10 prior to use. The protectant 400 might limit damage to the package 10 due to the package 10 being carried in a wallet, purse, pocket, diaper bag, auto glove compartment, or other such location that package 10 might be in prior to use. The protectant 400 might be releasably joined to the first side 40 of the backing layer 20 by an adhesive. The protectant 400 might be releasably joined to the backing layer 20 using any known approach for attaching two materials including, but not limited to, adhesive, glue, ultrasonic bonding, chemical bonding, thermal bonding, and fusion bonding.

The package 10 can be a dispensing package such as that disclosed in U.S. Pat. No. 7,506,762 B2. The package 10 can be a dispensing package such as that disclosed in U.S. Patent Pub. No. 2009/0074502 A1.

In one embodiment, the contact substrate 200 can be a polypropylene/polyethylene 70/30 hollow 16 segmented pie microfiber from ES Fibervisions/Chisso, referred to as code 020 having a fiber diameter of 2.2 denier, fiber length of 51 mm, and a basis weight of 60 g/m$^2$. In one embodiment, the contact substrate can be selected from the group consisting of a foam, a fibrous material, a film, a brush, and combinations thereof. Without being bound by theory, it is thought that a contact substrate 200 that presents a rough surface to the fabric being treated can improve stain treatment because the rough surface can aid with dislodging the stain from the fabric.

A contact substrate 200 comprising micro fibers can provide for effective stain removal. Without being bound by theory, it is thought that the micro fibers provide for smaller interstitial spaces between the fibers making up the contact substrate, such smaller spaces being able to hold greasy materials more effectively than a contact substrate 200 consisting of larger fibers. In one embodiment, the contact substrate 200 can comprise micro fibers having a diameter between about 0.1 micrometers and about 5 micrometers. In one embodiment, the contact substrate 200 can comprise microfibers having a diameter less than about 5 micrometers. The micro fibers can be notched-pie micro fibers, which have sharp fiber edges that are generated during formation of such micro fibers. The micro fibers can be staple fibers or continuous splitted fibers. The micro fibers can be split polypropylene-polyethylene micro fibers.

The contact substrate 200 can be selected from the group consisting of polyethylene, polypropylene, nylon, polyethylene terephthalate, rayon, and combinations thereof. Such fiber types are thought to possibly provide for stain lifting due to their molecular makeup. The contact substrate can be selected from the group consisting of a nonwoven comprising microfibers, a woven comprising microfibers, a looped woven comprising microfibers, and combinations thereof, with micro fibers being practical as discussed above.

Without being bound by theory, it is thought that for fabric stains comprising grease or oil the Hansen solubility parameters of the contact substrate 200 can be indicative of the ability of the contact substrate 200 to lift such stains from the fabric being treated. The book titled Hansen Solubility Parameters A User's Handbook, Second Edition, 2007, by Charles M. Hansen, published by CRC Press, Taylor & Francis Group LLC, Boca Raton, Fla., United States of America, is a treatise on Hansen solubility parameters. For a particular molecule, there are three Hansen solubility parameters: $\delta_D$, $\delta_P$, and $\delta_H$, where $\delta_D$ is the dispersion component of interaction energy between molecules per molar volume, $\delta_P$ is the polar component of interaction energy between molecules per molar volume, and $\delta_H$ is the bonding energy component of interaction energy between molecules per molar volume. The three parameters can be thought of as coordinates of a point in three dimensional space referred to as the Hansen space.

In the context of treatment of a stain, it is believed that the ability for a contact substrate 200 to lift a grease or oil stain from a fabric depends on the Hansen solubility parameters of the grease or oil stain to be removed from the fabric and the contact substrate 200. Stain lifting is thought to be provided for when the Hansen solubility parameters of the contact substrate 200 are proximal in Hansen space to the Hansen solubility parameters of the grease or oil stain being treated. When the Hansen solubility parameters of the contact substrate 200 and stain being treated are related as such, it is thought that the stain and the contact substrate 200 can be molecularly similar enough to one another such that the stain can be transferred from the stained fabric to the contact substrate 200.

The Hansen solubility parameters for a contact substrate 200 are determined using HSPiP Version 2.0 software available, as of Jan. 7, 2010, from http://www.hansen-solubility-.com/. The Hansen solubility parameters for each constituent polymer molecule of the contact substrate 200 are determined using the polymer HSP prediction tool in HSPiP by specifying the monomeric unit and attachment points using a modified SMILES notation. A repeat unit of 1 is used. If any of the Hansen solubility parameters are predicted by HSPiP Version 2.0 to be less than zero, such parameter is determined to have a value of zero.

For a contact substrate 200 that comprises two or more different molecules, the Hansen solubility parameters are computed based on a weighted mass fraction of the constituent molecules as follows:

$$\delta_x = \sum_{i=1}^{n} \phi_i \delta_{x,i}$$

where x is D, P, or H, depending on the specific Hansen Solubility Parameter being computed, i is the numerical identifier of the constituent molecule, and Φ is the mass fraction of the constituent molecule. Such an approach for determining the Hansen solubility parameters of a contact substrate 200 comprising two or more different molecules may not factor in how the spatial relationship of different molecules to the stain to be lifted might affect stain removal, for instance as might be the case for a fiber having a core/sheath arrangement.

A contact substrate 200 having Hansen solubility parameters that lie in or near the same general region of Hansen space as lard and olive oil, as reported by Hansen Solubility Parameters A User's Handbook, Second Edition, 2007, or taco grease, can be employed as the contact substrate 200. Such a contact substrate 200 might be able to provide for improved stain lifting, as compared to contact substrates 200 having Hansen solubility parameters that are distant from greases and oils in Hansen space.

Figure 15:
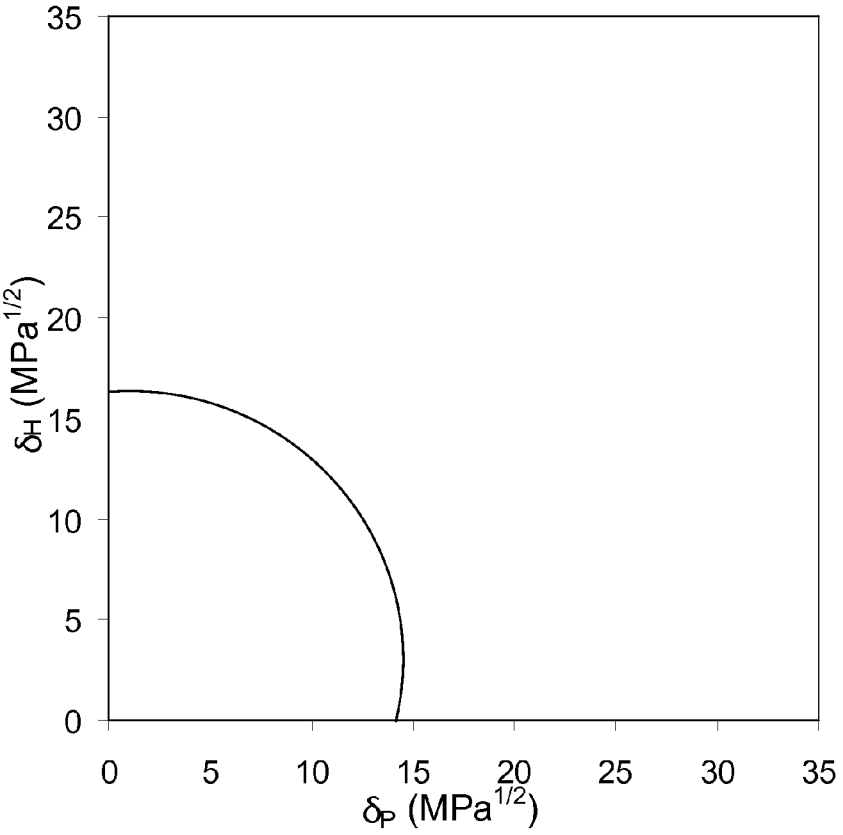
FIG. 15 is an illustration of the part of a Hansen space spherical volume having positive Hansen solubility parameters, with $\delta_H$ and $\delta_P$ presented to the viewer.
Figure 16:
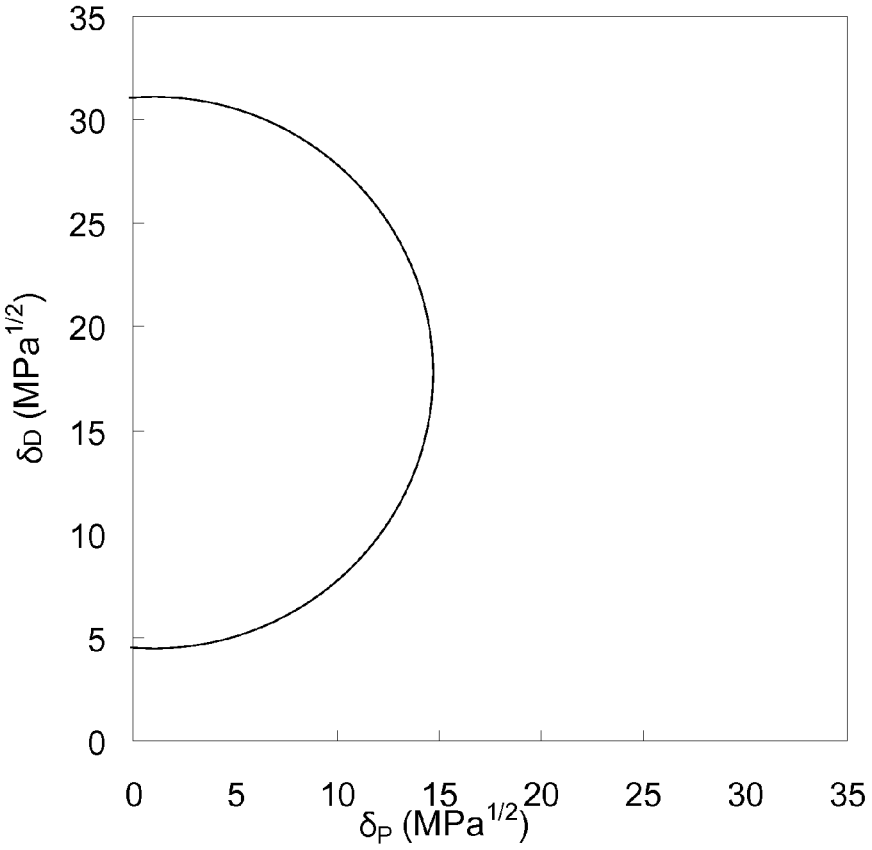
FIG. 16 is an illustration of the part of a Hansen space spherical volume having positive Hansen solubility parameters, with $\delta_D$ and $\delta_P$ presented to the viewer.

FIGS. 15 and 16 can be interpreted together to provide for a three-dimensional illustration of the Hansen space that can be of interest. The solid circular arc illustrated in FIGS. 16 and 17 represents the part of the edge of a Hansen space spherical volume for which $\delta_D$, $\delta_P$, and $\delta_H$ are positive. For instance FIG. 15 can be thought of as a side view of Hansen space in which $\delta_H$ and $\delta_P$ are presented to the viewer and FIG. 16 can be though of as a top view of Hansen space in which $\delta_D$ and $\delta_P$ are presented to the viewer. FIGS. 15 and 16 can be interpreted together to provide for a three-dimensional illustration of the Hansen space that can be of interest. The solid circular arcs illustrated in FIGS. 15 and 16 represents the part of the edge of a Hansen space spherical volume for which $\delta_D$, $\delta_P$, and $\delta_H$ are positive.

In one embodiment, the contact substrate 200 can comprise a fibrous material having positive Hansen solubility parameters falling within a Hansen space spherical volume of about 10000 $MPa^{3/2}$, the Hansen space spherical volume being centered at a dispersion component of interaction energy between molecules per molar volume $\delta_D$ of about 18 $MPa^{1/2}$, a polar component of interaction energy between molecules per molar volume $\delta_P$ of about 1 $MPa^{1/2}$, and a bonding energy component of interaction energy between molecules per molar volume $\delta_H$ of about 3 $MPa^{1/2}$. As used herein, the Hansen space spherical volume is considered to include negative Hansen solubility parameters such that the Hansen space spherical volume extends outside of what is described as the Hansen space in Hansen Solubility Parameters A User's Handbook, Second Edition, 2007. That is, the Hansen space spherical volume includes negative values of $\delta_D$, $\delta_P$, or $\delta_H$ that are outside of the Hansen space which is limited to positive values of $\delta_D$, $\delta_P$, or $\delta_H$. As such, for example, it can be understood that a contact substrate 200 having values of $\delta_D$, $\delta_P$, or $\delta_H$ greater than or equal to zero that fall within part of a Hansen space spherical volume can be of interest.

In one embodiment, the contact substrate 200 can comprise a fibrous material having Hansen solubility parameters greater than or equal to zero falling within a Hansen space spherical volume of about 10000 $MPa^{3/2}$, the Hansen space spherical volume being centered at a dispersion component of interaction energy between molecules per molar volume $\delta_D$ of about 18 $MPa^{1/2}$, a polar component of interaction energy between molecules per molar volume $\delta_P$ of about 1 $MPa^{1/2}$, and a bonding energy component of interaction energy between molecules per molar volume $\delta_H$ of about 3 $MPa^{1/2}$, and $\delta_D$ is between about 15 $MPa^{1/2}$ and about 20 $MPa^{1/2}$.

In other embodiments, the contact substrate 200 can comprise a fibrous material having Hansen solubility parameters greater than or equal to zero falling within a Hansen space spherical volume of about 9000 $MPa^{3/2}$, alternatively about 8500 $MPa^{3/2}$, alternatively about 8000 $MPa^{3/2}$, alternatively about 6000 $MPa^{3/2}$, alternatively about 4000 $MPa^{3/2}$, alternatively about 3000 $MPa^{3/2}$, the Hansen space spherical volume being centered at a dispersion component of interaction energy between molecules per molar volume $\delta_D$ of about 18 $MPa^{1/2}$, a polar component of interaction energy between molecules per molar volume $\delta_P$ of about 1 $MPa^{1/2}$, and a bonding energy component of interaction energy between molecules per molar volume $\delta_H$ of about 3 $MPa^{1/2}$.

In other embodiments, the contact substrate 200 can comprise a fibrous material having Hansen solubility parameters greater than or equal to zero falling within a Hansen space spherical volume of about 9000 $MPa^{3/2}$, alternatively about 8500 $MPa^{3/2}$, alternatively about 8000 $MPa^{3/2}$, alternatively about 6000 $MPa^{3/2}$, alternatively about 4000 $MPa^{3/2}$, alternatively about 3000 $MPa^{3/2}$, the Hansen space spherical volume being centered at a dispersion component of interaction energy between molecules per molar volume $\delta_D$ of about 18 $MPa^{1/2}$, a polar component of interaction energy between molecules per molar volume $\delta_P$ of about 1 $MPa^{1/2}$, and a bonding energy component of interaction energy between molecules per molar volume $\delta_H$ of about 3 $MPa^{1/2}$, and $\delta_D$ is between about 15 $MPa^{1/2}$ and about 20 $MPa^{1/2}$ for each of these defined Hansen space spherical volumes.

In other embodiments, the contact substrate 200 can comprise a fibrous substrate having Hansen solubility parameters $\delta_D$, $\delta_P$, and $\delta_H$ greater than or equal to zero wherein $[(\delta_D-18\ MPa^{1/2})^2+(\delta_P-1\ MPa^{1/2})^2+(\delta_H-3\ MPa^{1/2})^2]^{1/2}$ is less than about 13 $MPa^{1/2}$. In an another embodiment, the contact substrate 200 can comprise a fibrous substrate having Hansen solubility parameters $\delta_D$, $\delta_P$, and $\delta_H$ greater than or equal to zero wherein $[(\delta_D-18\ MPa^{1/2})^2+(\delta_P-1\ MPa^{1/2})^2+(\delta_H-3\ MPa^{1/2})^2]^{1/2}$, is less than about 11 $MPa^{1/2}$, alternatively less than about 9 $MPa^{1/2}$, alternatively less than about 7 $MPa^{1/2}$, alternatively less than about 5 $MPa^{1/2}$.

In an another embodiment, the contact substrate 200 can comprise a fibrous substrate having Hansen solubility parameters $\delta_D$, $\delta_P$, and $\delta_H$ greater than or equal to zero wherein $\delta_D$ is the dispersion component of interaction energy between molecules per molar volume, $\delta_P$ is the polar component of interaction energy between molecules per molar volume, and $\delta_H$ is the bonding energy component of interaction energy between molecules per molar volume, wherein $[(\delta_D-18\ MPa^{1/2})^2+(\delta_P-1\ MPa^{1/2})^2+(\delta_H-3\ MPa^{1/2})^2]^{1/2}$ is less than about 13 $MPa^{1/2}$ and $\delta_D$ is between about 15 $MPa^{1/2}$ and about 20 $MPa^{1/2}$.

In other embodiments, the contact substrate 200 can comprise a fibrous substrate having Hansen solubility parameters $\delta_D$, $\delta_P$, and $\delta_H$ greater than or equal to zero wherein $[(\delta_D-18\ MPa^{1/2})^2+(\delta_P-1\ MPa^{1/2})^2+(\delta_H-3\ MPa^{1/2})^2]^{1/2}$ is less than about 11 $MPa^{1/2}$, alternatively less than about 9 $MPa^{1/2}$, alternatively less than about 7 $MPa^{1/2}$, alternatively less than about 5 $MPa^{1/2}$, and $\delta_D$ is between about 15 $MPa^{1/2}$ and about 20 $MPa^{1/2}$ for each of these embodiments.

Without being bound by theory, it is believed that contact substrates 200 as described can not only function to deliver the stain treatment fluid 300 to the stained fabric and possibly acquire components of the strain by happenstance, but the contact substrate 200 itself can provide for improved removal of a stain having Hansen solubility parameters that lie in Hansen space proximal to the Hansen solubility parameters of the contact substrate 200, as compared to contact substrates 200 having Hansen solubility parameters that are distant from the stain being treated.

The composition of stain treatment fluid 300 may be one known in the art for stain treatment such as compositions containing a chelating agent, radical scavenger and preferably a bleach disclosed in U.S. Pat. No. 6,846,332.

The composition of stain treatment fluid 300 can be aqueous or non-aqueous. In one embodiment the composition comprises from 0% to about 99.99%, alternatively from about 70% to about 99.99%, alternatively from about 90% to about 99.9%, alternatively from about 94.0% to about 99.0%, by weight, of water and therefore be aqueous solutions.

The composition of stain treatment fluid 300 can comprise additional components such as bleach, surfactant, solvent, chelating agents, radical scavengers, and mixtures thereof.

The composition of stain treatment fluid 300 can comprise from about 0.001% to about 99.99%, alternatively from about 0% to about 15%, still alternatively from about 0.001% to about 7%, by weight of the composition, of bleach. In one embodiment, the bleach can be selected from the group consisting of peroxide bleach (such as N,N-Phthaloylaminoperoxycaproic acid or other peroxy-oic acid), hydrogen peroxide, and mixtures thereof. In one embodiment, the composition of stain treatment fluid 300 can comprise from about 0.5% to about 3%, by weight of the composition, of hydrogen peroxide. Peroxide sources other than hydrogen peroxide can be used herein. The comparative per-acids, per-salts, per-bleaches, metal catalysts, and the like known from the detergency art can be used.

The composition of stain treatment fluid 300 can comprise from about 0.001% to about 99.99%, alternatively from about 0.05% to about 5%, still alternatively from about 0.05% to about 2%, by weight of the composition, of surfactant. Surfactants can be selected from the group consisting of nonionic, anionic, cationic, zwitterionic surfactants, and mixtures thereof. Specific examples include ethoxylated alcohols or propoxylated, ethoxylated alcohols and sulfates of these, or alkyl phenols, alkyl carboxylates, alkyl sulfates, alkyl sulfonates, NaAES, NH4AES, alkyl quats, amine oxides, and mixtures thereof.

Nonionic surfactants such as the ethoxylated C10-C16 alcohols, e.g., NEODOL 23-6.5, low molecular weight alkyl/aryl amines, alkyl/aryl polyamines, or combinations there of may be used in the compositions. Alkyl sulfate surfactants which may be used herein as cleaners and to stabilize aqueous compositions are the C8-C18 primary ("AS"; preferred C10-C14, sodium salts), as well as branched-chain and random C10-C20 alkyl sulfates, and C10-C18 secondary (2,3)alkyl sulfates of the formula CH3(CH2)x(CHOSO3-M+)CH3 and CH3(CH2)y(CHOSO3-M+)CH2CH3 where x and (y+1) are integers of at least 7, preferably at least 9, and M is a water-solubilizing cation, especially sodium, potassium, and magnesium as well as unsaturated sulfates such as oleoyl sulfate. Alkyl ethoxy sulfate (AES) surfactants used herein are conventionally depicted as having the formula R(EO)xSO3Z, wherein R is C10-C16 alkyl, EO is —CH2CH2-O—, x is 1-10 and can include mixtures which are conventionally reported as averages, e.g., (EO)2.5, (EO)6.5 and the like, and Z is a cation such as sodium, ammonium, potassium, or magnesium (MgAES). In addition, surfactants such as quaternary alkyl ammonium compounds where suitable counterions could include but are not limited to chloride and alkyl sulfate. C8-C16 alkyl amine oxide surfactants can also be used.

The composition of stain treatment fluid 300 may comprise from 0% to about 99.99%, alternatively from about 0% to about 20%, still alternatively from 0% to about 10%, by weight of the composition, of a non-aqueous solvent. Solvents useful herein include butoxy propoxy propanol (BPP), benzyl alcohol, cyclohexanedimethylamine, glycol ethers such as diethylene glycol, dipropylene glycol and propylene glycol phenyl ether, or other solvents as described herein. In one embodiment, the solvent is an organic solvent. In one embodiment, the composition will comprise from about 1% to about 4% of BPP which is available in commercial quantities as a mixture of isomers in about equal amounts.

Other useful solvents are hydrotropes such as sodium toluene sulfonate and sodium cumene sulfonate, short-chain alcohols such as ethanol and isopropanol, and the like. They can be present in the compositions as only solvents or in combination with other solvents.

The weight ratio of solvent:surfactant(s) can be in the range of from about 10:1 to about 1:1. In one embodiment, the composition comprises 2% of a mixture of glycol ether and diethylene glycol solvent and 0.3% sodium lauryl sulfate.

The composition of stain treatment fluid 300 may include a chelating agent. The compositions can comprise up to about 5%, by weight of the total composition, of a chelating agent, or mixtures thereof. In one embodiment, the composition comprises from about 0.001% to about 1.5%, alternatively from about 0.001% to about 0.5%, and alternatively from about 0.001% to about 5%, of chelating agent, by weight of the stain treatment fluid.

Chelants that can include any of those known to those skilled in the art such as phosphonate chelating agents, amino carboxylate chelating agents, other carboxylate chelating agents, ethylenediamine N,N'-disuccinic acids, polyfunctionally-substituted aromatic chelating agents, citric acids, and mixtures thereof.

In one embodiment, the chelating agents can be amino aminotri(methylene phosphonic acid), di-ethylene-triamino-pentaacetic acid, diethylene triamine penta methylene phosphonate, 1,2-dihydroxy-3,5-benzenedisulfonic acid, 1-hydroxy ethane diphosphonate, ethylenediamine N,N'-disuccinic acid, and mixtures thereof.

The compositions herein may also contain organic stabilizers for improving the chemical stability of the composition, provided that such materials are compatible or suitably formulated. When incorporated, organic stabilizers can be used at levels from about 0.001% to about 5.0%, alternatively from about 0.001% to about 0.5%, by weight of the composition.

The composition of stain treatment fluid 300 may comprise a radical scavenger or a mixture thereof. Radical scavengers can be present herein in amounts ranging from up to about 10% by weight of the composition. In one embodiment, the composition comprises from about 0.001% to about 0.5%, by weight of the composition, of the radical scavenger.

Radical scavengers useful herein can comprise the well-known substituted mono and dihydroxy benzenes and their analogs, alkyl and aryl carboxylates and mixtures thereof. Specific examples include 3,4,5-trimethoxybenzoic acid (TMBA) and tetrabutyl ethylidenebisphenol.

The composition of stain treatment fluid 300 may comprise minor amounts of various optional ingredients, including enzymes, preservatives, anti-static agents, antioxidants/stabilizers, fragrance perfumes, odor absorbing components (such as cyclodextrins), bleach activators, builders, polymeric soil release agents, dispersant polymers, oil absorbing polymers; anti-tarnish and/or anti-corrosion agents, dyes, fillers, germicides, hydrotropes, solvotropes, enzyme stabilizing agents, solubilizing agents, clay soil removal/anti-redeposition agents, fabric softeners, dye transfer inhibiting agents, brighteners, bleach catalysts, static control agents, thickeners, and the like. If used, such optional ingredients can comprise from 0.0001% to 10%, alternatively from 0.01% to 2%, by weight, of the composition.

The pH of this formula can be chosen to maximize the cleaning efficacy of the specific formulation. When hydrogen peroxide is present in the formula, pH must be maintained between 3 and 6. When hydrogen peroxide is not present, pH can be higher. A buffer may be used to maintain the desired pH, for example, citric acid.

In one embodiment, the composition of stain treatment fluid 300 can be formulated so as to leave little visible residue on fabric surfaces after a stain on such fabric surface is treated. Accordingly, the composition of stain treatment fluid 300 may be substantially free of various polyacrylate-based emulsifiers, polymeric anti-static agents, inorganic builder salts and other residue-forming materials, except at low levels of from about 0.1% to about 0.3%, by weight of the composition, and preferably includes 0% of such materials (%, as used herein, denotes % by weight of 100% active). Similarly, water used in the compositions of stain treatment fluid 300 can be distilled, deionized or otherwise rendered free of residue-forming materials.

In one embodiment, compositions of stain treatment fluid 300 can be formulated as liquid fabric treatment compositions. In one alternative they may be provided as a gel.

Prophetic Examples of the Composition of Stain Treatment Fluid 300

Stain Treatment Fluid 300

Example 1

| % (wt) of 100% active component formula range | |
|---|---|
| Glycol Ether | 1.0-2.0 |
| Hydrogen peroxide | 1.0-3.0 |
| Alkyl sulfate surfactant | 0.3-1.0 |
| Perfume | 0.005-0.01 |
| Ethanol | 0.3-1.0 |
| BHT | 0.01-0.05 |
| Citric Acid | 0.03-0.1 |
| Water | Balance |

Stain Treatment Fluid 300

Example 2

| % (wt) of 100% active component formula range | |
|---|---|
| Diethylene Glycol | 1.0-2.0 |
| Hydrogen peroxide | 1.5-3.0 |
| LIPOLASE | 0.3-0.5 |
| Alkyl sulfate surfactant | 0.3-1.0 |
| Perfume | 0.005-0.01 |
| Ethanol | 0.3-1.0 |

-continued

| % (wt) of 100% active component formula range | |
|---|---|
| Trimethoxy benzoic acid | 0.01-.05 |
| Ethylene diamine-N-N'-dissuccinic acid chelating agent | 0.03-0.1 |
| Water | Balance |

Stain Treatment Fluid 300

Examples 3 & 4

| % (wt) of 100% active component formula range | | |
|---|---|---|
| | Ex. 3 | Ex. 4 |
| Glycol Ether | 1.50 | .50 |
| Diethylene Glycol | 1.00 | 1.50 |
| Hydrogen peroxide | 1.00 | 1.50 |
| Amine Oxide | 0.25 | 0.35 |
| Sodium Lauryl Sulfate | 1.00 | 0.80 |
| Perfume | 0.02 | 0.03 |
| Citric Acid | 1.0 | 0.07 |
| Magnesium Sulfate | 0.10 | 0.18 |
| Ethylene diamine-N-N'-dissuccinic acid | 0.0025 | 0.0015 |
| Water | Balance | Balance |

Stain Treatment Fluid 300

Example 5

| % (wt) of 100% active component formula range | |
|---|---|
| | Ex. 5 |
| Glycol Ether | 0-2% |
| Diethylene Glycol | 0-2% |
| Propyleneglycol phenyl ether | 0-3% |
| Hydrogen peroxide | 0-3% |
| Amine Oxide | 0-1.5% |
| C12 trimethyl ammonium chloride | 0-1.5% |
| Sodium Lauryl Sulfate | 0-3% |
| Alkyl benzene sulfonic acid | 0-3% |
| Perfume | 0-0.1 |
| Citric Acid | 0-0.3 |
| Magnesium Sulfate | 0-0.3 |
| Ethylene diamine-N-N'-dissuccinic acid | 0-0.3 |
| Water | Balance |
| pH | 3-9 |

Stain Treatment Fluid 300

Examples 6-12

| % (wt) of 100% active component formula range | | | | | | | |
|---|---|---|---|---|---|---|---|
| | Ex. 6 | Ex. 7 | Ex. 8 | Ex. 9 | Ex. 10 | Ex. 11 | Ex. 12 |
| Glycol Ether | 0 | 0 | 0 | 0 | 0.5 | 1 | 1 |
| Diethylene Glycol | 0 | 0 | 1 | 0 | 0.5 | 0 | 1 |
| Propyleneglycol Phenyl Ether | 0 | 1.5 | 2 | 0 | 1.5 | 2 | 1.5 |
| Hydrogen Peroxide | 1 | 1 | 0 | 1 | 1 | 0 | 1 |

-continued

| | % (wt) of 100% active component formula range | | | | | | |
|---|---|---|---|---|---|---|---|
| | Ex. 6 | Ex. 7 | Ex. 8 | Ex. 9 | Ex. 10 | Ex. 11 | Ex. 12 |
| Amine Oxide | 0.3 | 0.3 | 1 | 0 | 0 | 0 | 0.3 |
| C12 Trimethyl Ammonium Chloride | 0 | 0 | 0 | 0.3 | 0.3 | 1 | 0 |
| Sodium Lauryl Sulfate | 0 | 0.9 | 0.9 | 0 | 0.9 | 1.2 | 0.9 |
| Alkyl Benzene Sulfonic Acid | 0.9 | 0 | 0 | 0.9 | 0 | 0 | 0 |
| Perfume | 0.025 | 0.02 | 0.05 | 0.05 | 0.02 | 0.05 | 0.02 |
| Citric Acid | 0.15 | 0.08 | 0.3 | 0.2 | 0.08 | 0.3 | 0.15 |
| Magnesium Sulfate | 0.15 | 0 | 0 | 0.15 | 0 | 0 | 0.15 |
| Ethylene Diamine-N-N'-Dissuccinic Acid | 0 | 0.0025 | 0.3 | 0 | 0.0025 | 0.3 | 0.0025 |
| Water | Balance | Balance | Balance | Balance | Balance | Balance | Balance |
| pH | 3 | 6 | 8 | 3 | 6 | 8 | 6 |

The contact substrate 200 can have at least one side that is light colored. A light colored contact substrate 200 can function as an indicator that the stain being treated is being effectively lifted from the fabric being treated and being transferred to the contact substrate 200. As the contact substrate 200 acquires the stain, the color of the contact substrate may tend to darken. For stains on patterned fabrics, which may be hard to see in low lighting situations, such as a restaurant, where stains are likely to occur, having a light colored contact substrate 200 that darkens when used can help the user of the contact substrate monitor that the stain is being removed.

A contact substrate 200 can have a L* value greater than about 80. A contact substrate 200 can have an L* value greater than about 85. A contact substrate 200 can have an L* value greater than about 90. A contact substrate 200 can have an L* value greater than about 95. A contact substrate 200 can have an L* value of greater than about 90 and an a* value between about −5 and about 5 and a b* value between about −5 and about 5.

The color of a contact substrate 200 is measured by the reflectance spectrophotometer according to the colors L*, a*, and b* values. If the contact substrate 200 is joined to a backing layer 20, the L*, a*, and b* values of the contact substrate 200 are measured on the side of the contact substrate 200 that is oriented away from the backing layer 20.

Reflectance color is measured using the Hunter Lab LabScan XE reflectance spectrophotometer obtained from Hunter Associates Laboratory of Reston, Va. A contact substrate 200 is tested at an ambient temperature between 65° F. and 75° F. and a relative humidity between 50% and 80%.

The spectrophotometer is set to the CIELab color scale and with a D65 illumination. The Observer is set at 10° and the Mode is set at 45/0°. Area View is set to 0.125" and Port Size is set to 0.20". The spectrophotometer is calibrated prior to sample analysis utilizing the black glass and white reference tiles supplied from the vendor with the instrument. Calibration is done according to the manufacturer's instructions as set forth in LabScan XE User's Manual, Manual Version 1.1, August 2001, A60-1010-862. If cleaning is required of the reference tiles or samples, only tissues that do not contain embossing, lotion, or brighteners should be used (e.g., PUFFS tissue). Any sample point on the contact substrate 200 facing away from the first side 40 of the backing layer 20 can be selected.

The contact substrate 200 is placed over the sample port of the spectrophotometer with a white clamp disk placed behind the contact substrate 200. The contact substrate is to be in a substantially flat condition and free of wrinkles.

The contact substrate is removed and repositioned so that a minimum of three readings of color of the contact substrate are conducted. Each of the readings is to be performed at a different region of the contact substrate so that no two sample points overlap. The readings are averaged to yield the reported L*, a*, and b* values.

The package 10, as described herein, can be used in a method for treating a stained fabric. The steps of the method can include bending the backing layer 20 about the line of weakness 130 to move the first planar region 22 and the second planar region 24 into a substantially facing relationship, thereby making a portion of the backing layer 20 to be discontinuous across the line of weakness 130. The stain treatment fluid 300 can be dispensed to the first side 40 of the backing layer 20 through the portion of the backing layer 20 that is discontinuous across the line of weakness 130. The backing layer can then gripped by the user and the stained fabric is rubbed with the portion of the backing layer 20 that is discontinuous across the line of weakness 130. If a contact substrate 200 is part of the package 10, the stain treatment fluid 300 is dispensed to the fluid pervious contact substrate 200 joined to the first side 40 of the backing layer 20 proximal the line of weakness 130, as part of the method. If a distribution layer 120 is present, the stain treatment fluid 300 can be transported through the distribution layer 120 to the contact substrate 200.

The method can be performed on a garment while the user of the package 10 is wearing the garment. The stained fabric can be a fibrous woven or nonwoven web. For example, the stained fabric can be part of a garment. In one embodiment, the method can be employed to treat a grease or oil stain on a fabric.

All percentages and ratios used herein are by weight of the total composition and all measurements made are at 25° C., unless otherwise designated. An angular degree is a planar unit of angular measure equal in magnitude to 1/360 of a complete revolution.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

All documents cited are, in relevant part, incorporated herein by reference; the citation of any document is not to be construed as an admission that it is prior art with respect to the present invention.

What is claimed is:

1. A package for treating a stained fabric, said package comprising:

a backing layer having a first side opposing a second side, said backing layer having a line of weakness, said second side having a first planar region and a second planar region on opposing sides of said line of weakness;

a pouch layer joined with said second side of said backing layer thereby forming a pouch, said pouch containing a stain treatment fluid; and a fluid pervious contact substrate joined to said first side of said backing layer proximal said line of weakness;

wherein said package has a first position in which said first planar region and said second planar region are substantially in plane with one another;

wherein said package has a second position in which said first planar region and said second planar region are in a substantially angularly facing relationship;

wherein in said first position at least a portion of said first planar region and at least a portion of said second planar region are integral with one another and in said second position at least a portion of said backing layer is discontinuous across said line of weakness;

wherein in said second position said pouch is in fluid communication with said contact substrate;

wherein said stain treatment fluid comprises from about 0.001% to about 99.99%, by weight of said stain treatment fluid, of a surfactant; and wherein a distribution layer is disposed in facing relationship with said contact substrate and between said backing layer and said contact substrate, wherein said pouch contains a volume of stain treatment fluid, wherein said distribution layer has a free absorbent capacity, wherein said free absorbent capacity is less than said volume of stain treatment fluid.

2. The package of claim 1, wherein said line of weakness is in said first side of said backing layer.

3. The package of claim 1, wherein said line of weakness is selected from the group consisting of a score, a frangible portion, perforations, a slit, an aperture, and combinations thereof.

4. The package of claim 1, wherein in said second position, said first planar region and said second planar region are disposed at an interior angle of less than about forty-five degrees.

5. The package of claim 1, wherein said contact substrate is selected from the group consisting of a foam, a fibrous material, a film, a brush, and combinations thereof.

6. The package of claim 1, wherein said contact substrate is joined with said first side of said backing layer by at least two hinges, each hinge comprising a material joined in part to said first side of said backing layer and joined in part to said contact substrate.

7. The package of claim 6, wherein a foundation layer is joined to said contact substrate and said foundation layer is between said contact substrate and said backing layer, wherein said hinges are joined to said foundation layer.

8. The package of claim 7, wherein said foundation layer is selected from the group consisting of a porous film, a slit film, an apertured film, a woven, a nonwoven, and combinations thereof.

9. The package of claim 1, wherein said backing layer has a first elastic limit, wherein said package further comprises a coating layer joined to and facing said second side of said backing layer, said coating layer comprising a transmitting portion substantially aligned with said line of weakness, said coating layer having a second elastic limit greater than said first elastic limit, wherein said pouch layer is joined to said coating layer thereby forming said pouch there between.

10. The package of claim 9, wherein said transmitting portion is selected from the group consisting of a score, a frangible portion, perforations, a slit, an aperture, and combinations thereof.

11. The package of claim 1, wherein said contact substrate comprises micro fibers having a diameter less than about 5 micrometers.

12. The package of claim 1, wherein said contact substrate comprises fibers selected from the group consisting of polyethylene, polypropylene, nylon, polyethylene terephthalate, rayon, and combinations thereof.

13. The package of claim 1, wherein said contact substrate is selected from the group consisting of a nonwoven comprising microfibers, a woven comprising microfibers, a looped woven comprising microfibers, and combinations thereof.

14. The package of claim 11, wherein said micro fibers are notched-pie microfibers.

15. The package of claim 11, wherein said micro fibers are staple fibers or continuous splitted fibers.

16. The package of claim 11, wherein said micro fibers are split polypropylene-polyethylene fibers.

17. The package of claim 1, wherein said distribution layer comprises a needle punched fibrous material.

18. The package of claim 1, wherein said pouch layer is joined with said backing layer thereby forming a first pouch and a second pouch, said first pouch and said second pouch separated by a separating portion.

19. The package of claim 1, wherein said contact substrate has an L* value measured by a reflectance meter greater than about 80.

20. The package of claim 1, wherein said stain treatment fluid comprises from about 0.05% to about 5%, by weight of the composition, of said surfactant.

21. The package of claim 1, wherein said surfactant is selected from the group consisting of nonionic surfactants, anionic surfactants, cationic surfactants, zwitterionic surfactants, and mixtures thereof.

22. The package of claim 1, wherein said stain treatment fluid further comprises from about 0.001% to about 99.99%, by weight of said stain treatment fluid, of a bleach.

23. The package of claim 22, wherein said stain treatment fluid comprises from about 0.001% to about 7%, by weight of said stain treatment fluid, of said bleach.

24. The package of claim 22, wherein said bleach is selected from the group consisting of peroxide bleach, hydrogen peroxide, and mixtures thereof.

25. The package of claim 1, wherein said stain treatment fluid further comprises from about 0.001% to about 5%, by weight of said stain treatment fluid, of a chelant.

26. The package of claim 25, wherein said stain treatment fluid comprises from about 0.001% to about 1.5%, by weight of said stain treatment fluid, of a chelant.

27. The package of claim 25, wherein said chelant is selected from the group consisting of phosphonate chelating agents, amino carboxylate chelating agents, carboxylate chelating agents, ethylenediamine N,N'-disuccinic acids, polyfunctionally-substituted aromatic chelating agents, citric acids, and mixtures thereof.

28. The package of claim 1, wherein said stain treatment fluid comprises:

a) from about 0.001% to about 99.99%, by weight of said stain treatment fluid, of a surfactant selected from the group consisting of nonionic surfactants, anionic surfactants, cationic surfactants, zwitterionic surfactants, and mixtures thereof;

b) from about 0.001% to about 99.99%, by weight of said stain treatment fluid, of a bleach;

c) from about 0.001% to about 5%, by weight of said stain treatment fluid, of a chelant; and d) a perfume.

* * * * *